US006804923B1

(12) United States Patent
Potter

(10) Patent No.: US 6,804,923 B1
(45) Date of Patent: Oct. 19, 2004

(54) PREFABRICATED MODULAR DECK SYSTEM

(76) Inventor: John Potter, 6731 Orchard Ridge Trail, Woodbury, MN (US) 55125

( * ) Notice: Subject to any disclaimer, the term of this patent is extended or adjusted under 35 U.S.C. 154(b) by 0 days.

(21) Appl. No.: 09/608,816

(22) Filed: Jun. 30, 2000

Related U.S. Application Data

(60) Provisional application No. 60/142,273, filed on Jul. 2, 1999.

(51) Int. Cl.[7] ..... E04F 15/00

(52) U.S. Cl. ..... 52/480; 52/763; 52/664; 52/403.1

(58) Field of Search ..... 52/479, 480, 177, 52/384, 390, 385, 403.1, 763, 391, 392, 588.1, 589.1, 592.1, 590.1, 612, 664, 665, 650.3

(56) References Cited

U.S. PATENT DOCUMENTS

| | | | | | |
|---|---|---|---|---|---|
| 3,504,472 | A | | 4/1970 | Clement | 52/477 |
| 3,723,233 | A | | 3/1973 | Bourke | 161/68 |
| 3,963,846 | A | | 6/1976 | Bourke | 428/73 |
| 4,028,858 | A | * | 6/1977 | Rehbein | 52/384 |
| 4,344,262 | A | | 8/1982 | Berman et al. | 52/227 |
| 4,506,482 | A | | 3/1985 | Pracht et al. | 52/235 |
| 4,594,833 | A | | 6/1986 | Mieyal | 52/806 |
| 4,622,792 | A | | 11/1986 | Betts | 52/263 |
| 4,658,562 | A | | 4/1987 | Brugman | 52/665 |
| 4,664,955 | A | | 5/1987 | Clem | 428/15 |
| 4,691,484 | A | | 9/1987 | Wilson | 52/79.6 |
| 4,712,340 | A | | 12/1987 | Sogge | 52/177 |
| 4,741,138 | A | | 5/1988 | Rongoe, Jr. | 52/334 |
| 4,840,825 | A | | 6/1989 | Aristodimou | 428/77 |
| 4,944,127 | A | * | 7/1990 | Clear | 52/309 |
| 4,972,537 | A | | 11/1990 | Slaw, Sr. | 14/1 |
| 5,143,418 | A | | 9/1992 | Fouquet | 296/182 |
| 5,311,629 | A | | 5/1994 | Smith | 14/73.1 |
| 5,314,554 | A | | 5/1994 | Owens | 156/154 |
| 5,339,581 | A | | 8/1994 | Schlickenmeyer | 52/177 |
| 5,361,554 | A | | 11/1994 | Bryan | 52/480 |
| 5,367,853 | A | | 11/1994 | Bryan | 52/702 |
| 5,394,667 | A | * | 3/1995 | Nystrom | 52/480 |
| 5,406,765 | A | | 4/1995 | Brown | 52/409 |
| 5,411,782 | A | | 5/1995 | Jarvis et al. | 428/57 |
| 5,441,786 | A | * | 8/1995 | Manassa | 428/50 |
| 5,465,546 | A | | 11/1995 | Buse | 52/480 |
| 5,511,353 | A | | 4/1996 | Jones | 52/536 |
| 5,623,803 | A | | 4/1997 | Willis | 52/650.3 |
| 5,632,123 | A | | 5/1997 | Erwin | 52/177 |
| 5,647,184 | A | | 7/1997 | Davis | 52/592 |
| 5,749,188 | A | | 5/1998 | Belbenoit | 52/263 |
| 5,813,365 | A | | 9/1998 | Helmy | 119/528 |
| 5,899,029 | A | | 5/1999 | Spahr | 52/126.5 |
| 6,035,588 | A | | 3/2000 | Zehner et al. | 52/98 |
| 6,170,105 | B1 | | 1/2001 | Doyle | 14/73 |
| 6,209,267 | B1 | | 4/2001 | Dantzer | 52/79.6 |
| 6,247,286 | B1 | | 6/2001 | Heyns | 52/589.1 |

FOREIGN PATENT DOCUMENTS

| | | |
|---|---|---|
| DE | 8517514 | 8/1985 |
| DE | 3726373 A1 | 1/1989 |
| EP | 0053092 A | 6/1982 |
| EP | 0321748 | 6/1989 |
| EP | 0485297 A1 | 5/1992 |
| FR | 2349420 A | 11/1977 |

* cited by examiner

*Primary Examiner*—Brian E. Glessner
(74) *Attorney, Agent, or Firm*—Fulbright & Jaworski L.L.P.

(57) ABSTRACT

A modular prefabricated deck system which includes a plurality of rectangular flooring modules. Each module may include a plurality of laminations, such as a decorative upper element, and a lower support element for supporting the module upon the underlying joist structure of the deck. Additionally, each module may include interlocking structure for engaging adjacent modules upon installation.

12 Claims, 9 Drawing Sheets

PREFABRICATED MODULAR DECK SYSTEM

RELATED APPLICATION

This application hereby incorporates by reference and, under 35 U.S.C. §119(e), claims the benefit of priority of U.S. Provisional Patent Application No. 60/142,273, filed Feb. 2, 1999.

TECHNICAL FIELD

This invention generally relates to a prefabricated deck system, and in particular to a prefabricated modular deck panel and sub-structure for construction of a deck.

BACKGROUND OF THE INVENTION

Exterior decks and similar outdoor wood platform structures have become commonplace additions to houses and other residential and commercial structures. A value of such deck structures is derived from an enlargement of the usable space for entertainment, etc., as well as an enhancement in the quality of outdoor activities such as relaxation. As a result, outdoor decks have become increasingly popular in residential home construction. Residential homes, as well as a variety of other buildings, often incorporate exterior decks into their design. Additionally, decks are commonly added onto existing structures.

The dominant method of deck construction includes: (1) a number of vertical posts which support the remaining structure above the ground; (2) horizontal beams supported above the ground by the vertical posts; (3) a number of horizontal joints, parallel to and uniformly spaced apart from one another and anchored to the beams; and (4) a floor surface of decking planks arranged horizontally and above and perpendicular to the joists. Deck construction typically utilizes common dimensional lumber and entails site construction of the deck of a size and configuration which is unique to a particular site. Limitations of the common lumber-based deck structures are well known. During construction, warped or mis-shaped lumber impedes quick application of the decking lumber to the support structure. Additionally, wood flooring of deck structures requires periodic attention to maintain appearance and delay structural deterioration. For a variety of reasons, the availability of natural weather-resistant woods (redwood, cedar, teak, etc.) has become both limited and expensive. Chemically treated wood product may be utilized to delay natural fungal deterioration. However, chemicals such as chromated copper arsenic (CCA) are used in the treatment process. Once incorporated into the deck structure, such chemically treated lumber may leach CCA or its derivatives into the surrounding environment. Maintenance of wood deck structures often includes periodic application of wood preservatives, stains, etc. In sum, known wood-based deck structures present substantial limitations.

Also known are synthetic or synthetic/wood product combination lumber, such as TREX® brand polymer wood lumber manufactured by the TREX Corporation. Limitations of such lumber include the requisite slat-like aesthetic of the installed decking surface and the limited availability of color and texture combinations.

Modular deck systems are known. Typically, the modular systems include prefabricated wood panels for the deck flooring. Various types of prefabricated wood panel have been employed and usually constructed of individual boards secured together to form a panel. The prefabricated panels have been constructed with various approaches to securing the panels to an underlying support structure or substructure. One example is U.S. Pat. No. 4,622,792 to Betts, which discloses a wood-based modular deck structure comprising a plurality of rectangular flooring platforms and cooperating rectangular frames defined by intersecting joist members.

U.S. Pat. No. 5,361,554 to Bryan discloses a suspended deck system using prefabricated deck block modules as the deck surface. The block modules cooperate with a rectangular frame structure defined by intersecting joist members U.S. Pat. No. 4,028,858 to Rehbein discloses a suspended deck system using rectangular deck modules as the deck surface. The deck modules are interconnected with embedded pins to limit movement. A frame structure defined by parallel joist members supports the interconnected deck modules.

Accordingly, it can be seen that a need exists in the art for a modular decking system which can be produced and applied ecologically and economically. It is to the provision of such a decking system that the present invention is primarily directed.

SUMMARY OF THE PRESENT INVENTION

The present invention provides a deck structure with improved deck surface aesthetic and durability. The deck structure according to the present invention includes a plurality of prefabricated deck modules disposed upon an underlying support structure. The support structure may include the plurality of deck joists and a cooperating grid or network. The prefabricated deck modules may be manufactured from a variety of materials, such as concrete, natural stone, or polymer products. The deck modules may be disposed upon an existing deck joist structure as during deck renovation or repair, or they may be integrated as a deck surface of a new prefabricated deck. The grid support structure may include a plurality of channel members secured and extending in interlocking manner parallel to and across the joist members of a deck structure. The grid substructure assembly laterally restrains the deck modules from movement and provides an improved deck system in which the edges of the deck modules are uniformly spaced from the edges of adjacent deck modules. Desirably, a relatively seamless deck surface aesthetic may thus be achieved. The channel members may include a pair of flanges for securing the channel member to the joist members. Furthermore, the channel members may include structure at regularly spaced intervals along the length of the channel members to engage each other and defined a plurality of rectangular support frames for the deck modules. The structure may include regularly spaced slots on the upwardly directed web of one channel member, and regularly spaced removed portions of opposed horizontal webs of another channel member (the slot and removed portions interlocking each other in perpendicular manner).

It is an object of the present invention to provide a modular deck flooring system which is easy to install, and which possesses numerous advantages over the prior art deck floors. A decrease in maintenance and a more aesthetically appealing deck surface is thus provided.

In accordance with the invention, a deck system includes a plurality of individual prefabricated deck modules which are retained by a support structure. The modules may be manufactured through a variety of approaches, materials, techniques, etc. In one preferred form, the modules may be a cast concrete product, a synthetic polymer product, a natural stone product, or a combination thereof. In another preferred form, the modules include a lower composite material support layer, such as a plywood element, and an upper natural stone facing layer. Additionally, the preferred modules may have a recessed feature for minimizing the gap between installed adjacent modules.

In another preferred embodiment, the prefabricated deck modules may include a tongue and groove structure for interconnecting adjacent modules during deck construction. In yet another preferred embodiment, the deck module may include a laminate structure having a top natural stone laminate, and a lower plywood-based laminate having tongue and groove structures for engaging adjacent modules.

These and other objects, features and advantages of the present invention will become apparent to one skilled in the art upon analysis of the following detailed description in view of the drawings.

BRIEF DESCRIPTION OF THE DRAWINGS

Yet other objects and advantages of the present invention may be seen from the followed detailed description taken in conjunction with the accompanying drawings wherein like numerals depict like parts throughout, and wherein.

DESCRIPTION OF PREFERRED EMBODIMENTS OF THE INVENTION

Figure 1:
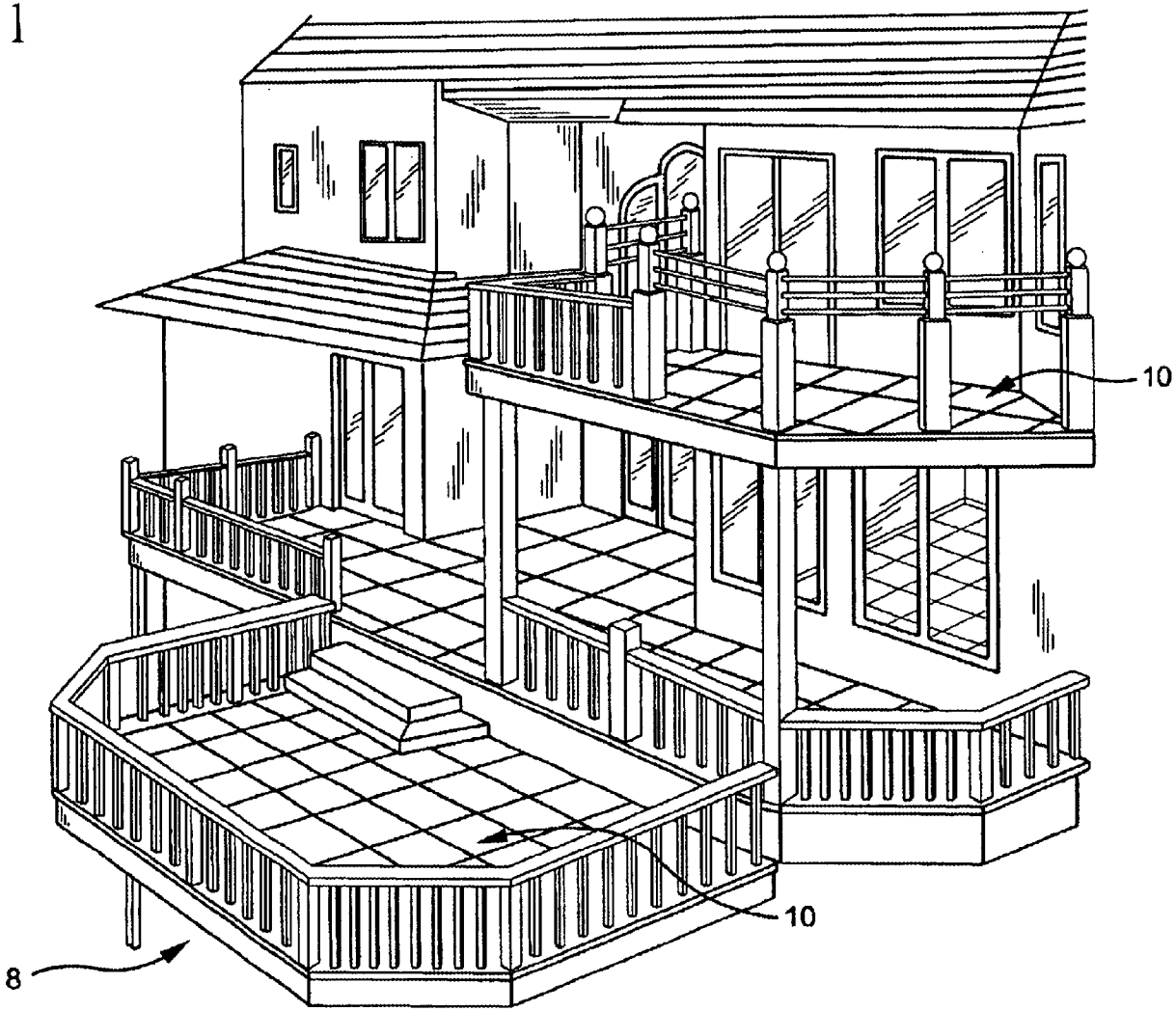
FIG. 1 illustrates is a perspective view of a deck structure according to the present invention.

FIG. 1 illustrates a house 6 having a deck structure 8 devised according to concepts of the present invention. Deck structure 8 includes a plurality of modular deck panels 10 disposed in cooperating relationship to form a deck surface.

Figure 2:
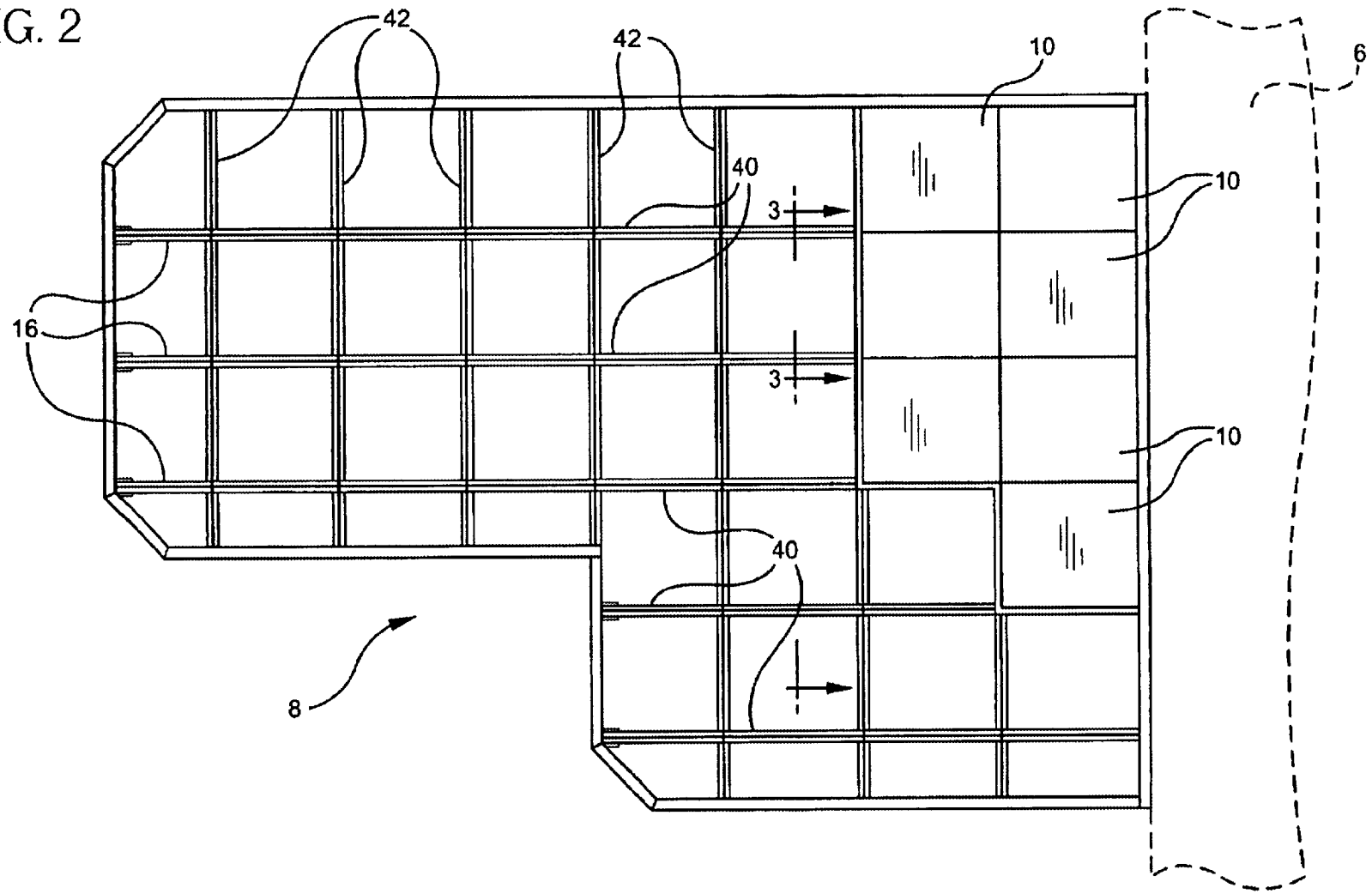
FIG. 2 is a top plan view of a portion of the deck structure of FIG. 1.

One embodiment of a deck structure 8 is illustrated in FIG. 2, wherein the deck panels 10 are disposed in cooperating relationship with an interlocking grid support network 12. The deck panels 10 and grid network 12 are preferably sized for placement on new or existing deck joist structure featuring regularly spaced joists 16. For common 16 inch-on-center deck joisting, a deck panel 10 according to the present invention is approximately 16 inches square. It is appreciated that alternative sized deck panels 10 may also be practicable. It should also be appreciated that alternative configurations (other than rectangular) may be also be practicable. For instance, diamond-shaped deck panels 10, etc., may be practicable. Additionally, alternative module 10 support approaches may also be practicable, such as discussed hereinafter.

Figure 3:
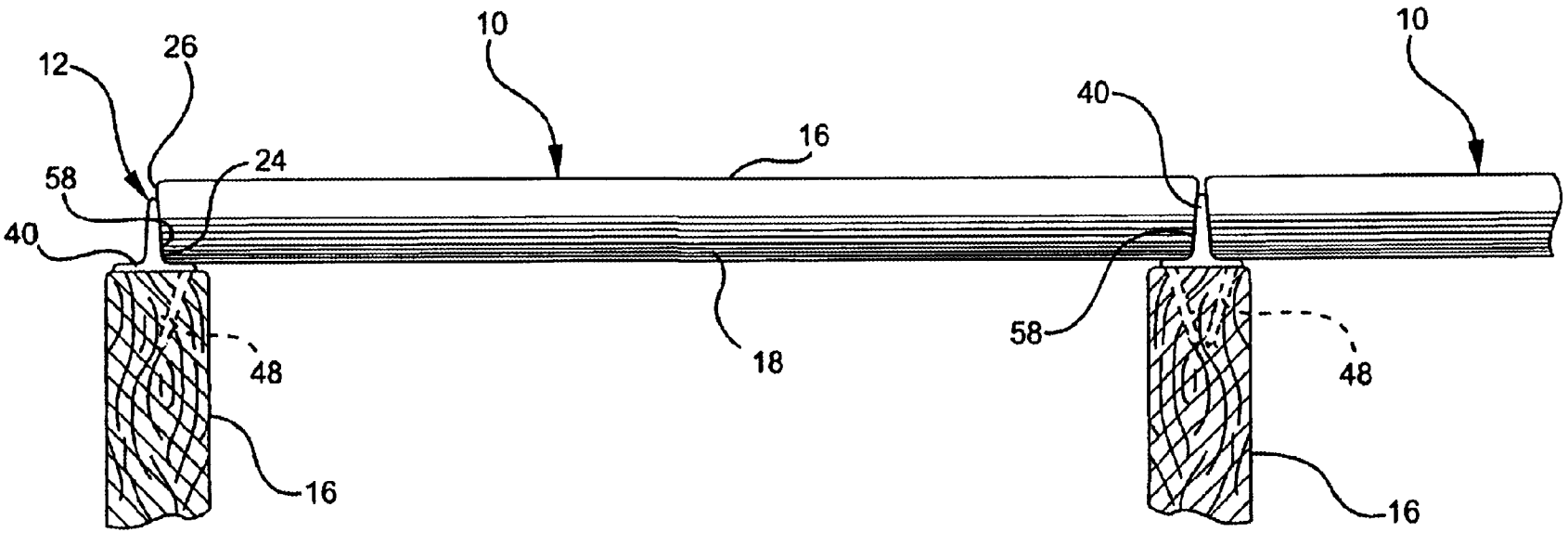
FIG. 3 is a side elevational view of a portion of the deck structure of FIG. 1, as viewed across lines 3—3 of FIG. 2.
Figure 4:
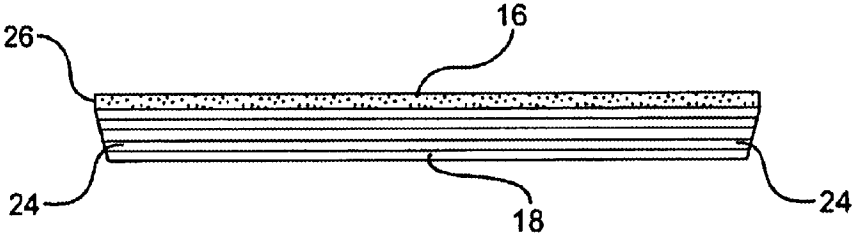
FIG. 4 is an elevational view of an individual block module of FIG. 1.

Focusing first on the deck panels or modules 10, and with reference to FIGS. 3–6, the manufacture of the prefabricated deck panels 10 may include a variety of known materials and processing techniques. For instance, the deck panel 10 may be a unitary cast concrete-based module 10 (not shown) having a grid of reinforcing elements retained within the concrete. The reinforcing elements may be metal webbing or possibly polymer strips. Alternatively, and as illustrated in FIGS. 3 and 4, the module 10 may include an upper layer 17 disposed upon a plywood-type material support structure 18. Upper layer 17 of the module panels 10 may be decorated with known concrete finishing techniques to imitate a variety of natural stone products (for instance, BOMANITE® finishes, etc.). Alternatively, the upper layer 17 may be decorated with brick patterns (random, interlocking, ashlar, etc.). A variety of decorative finishes for a concrete-based deck panel 10 are thus envisioned from plain unfinished concrete to imitation stone or brick.

Referring particularly to FIGS. 3 and 4, the side edges of the deck panels 10 may include a tapered or recessed portion 24 designed to cooperate with the grid-like deck panel support structure 12 as described hereinafter. The taper or recessed portion 24 defines an overhanging portion 26 of the deck module 10 to promote a minimization of the gap between installed adjacent deck panel portions 10. In one embodiment, the tapered portion 24 of the side edges includes a linear taper of approximately ¼ inch. A variety of alternative tapered or recessed portions 24 may be practicable to achieve the object of minimizing the gap between adjacent deck panel portions 10. In the embodiment of FIGS. 3 and 4, the recessed portion 24 is a continuous feature, as compared to the intermittent or discontinuous recessed portion or pocket 24 of FIGS. 14–15.

Figure 5:
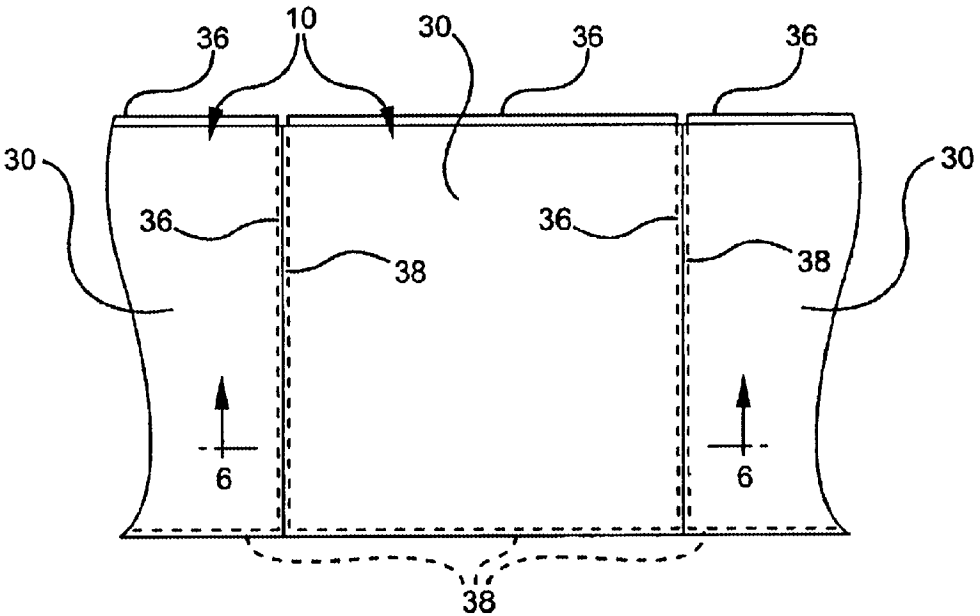
FIG. 5 is a top plan view of a second embodiment of the block modules.
Figure 6:
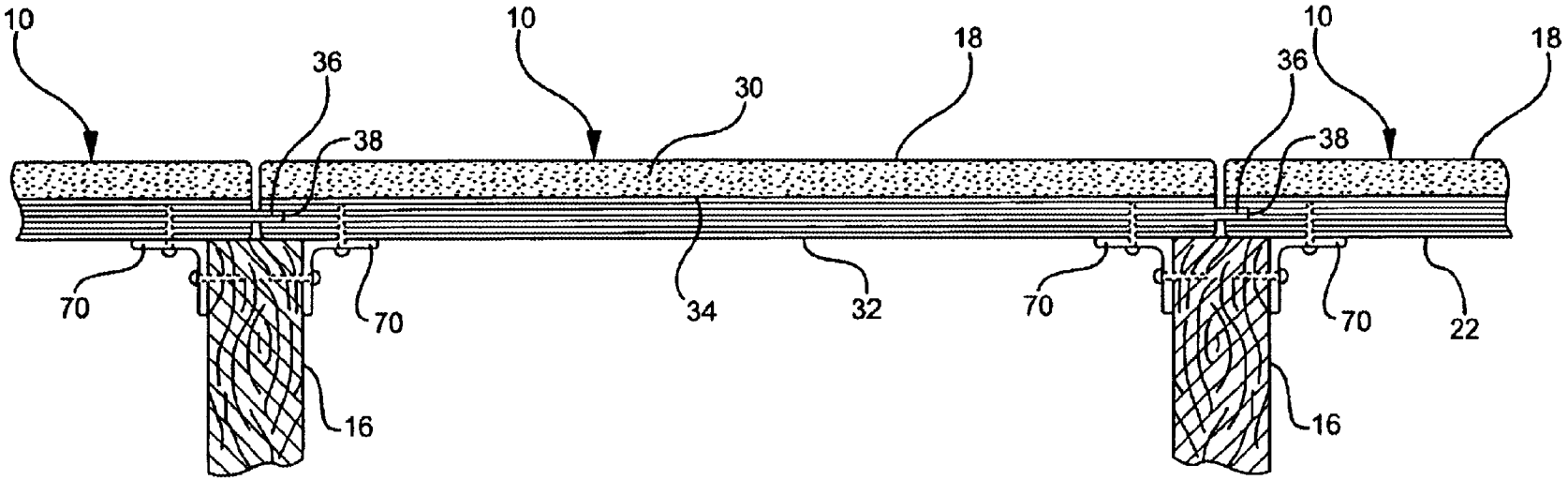
FIG. 6 is a cross sectional view of the individual block modules of FIG. 5 as taken along lines 6—6.
Figure 8:
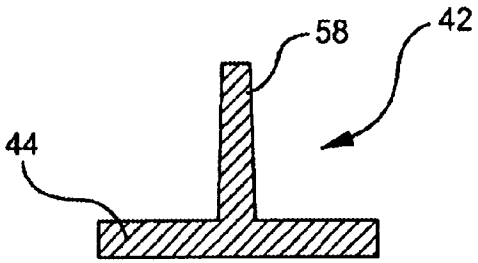
FIG. 8 is a cross sectional view of a second support channel member.
Figure 7:
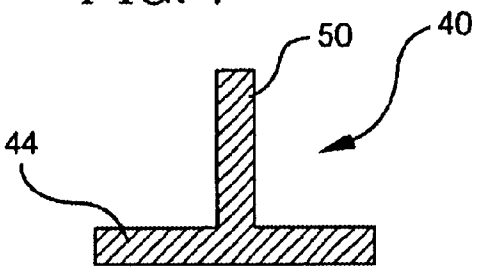
FIG. 7 is a cross sectional view of a first support channel member.

Referring now to FIGS. 5 and 6, a second embodiment of the prefabricated deck panels 10 is illustrated. Deck panel 10 may include a natural stone facing or veneer element 30 secured to an underlying support structure 32. The natural stone veneer 30 may be selected from among a group of architectural stone materials such as granite, sandstone, etc. The underlying support structure 32 may include a plywood-based material, a concrete-based reinforced product, or a polymer, fiberglass, or composite material product providing suitable structural characteristics. A polymer support structure 32 may include a honeycomb or other cellular structure to achieve an improved weight versus strength ratio. A natural stone veneer 30 may be secured to the underlying support structure 32 through known securement approaches, such as adhesives 34, thin-set mortars, mechanical fasteners, etc.

Additionally, the deck panels 10 of FIGS. 5 and 6 define a tongue and groove structure 36, 38 for engaging adjacent deck panels 10. A variety of engaging structures may also be practicable, in addition to the tongue and groove structures 36, 38 of FIGS. 5 and 6, including but not limited to channels, splines, pins, biscuit-type interconnects, etc.

Referring now to FIGS. 7–13, a construction and application of the module support structure 12 of FIG. 2 will be described. The module support structure 12 includes a plurality of elongated channel members 40, 42 adapted to be longitudinally secured to the joists 16 of the deck structure 8 and laterally interconnected together from joist 16 to joist 16. The channel members 40, 42 may be manufactured from materials known to those skilled in the art, which include metals, polymers, composites, etc. In one preferred embodiment, the channel members 40, 42 are polymer products. Two cooperating channel members 40, 42 are described herein. It should be appreciated that alternative channel configurations 40, 42 sizes, design, and implementation may also be practicable.

The first channel member 40 includes a generally horizontal flange 44 having a plurality of apertures 46 spaced therealong through which fasteners 48 (nails, screws, etc.) may be received to secure the first channel member 40 longitudinally upon a joist member 16 of the deck structure 8. The first channel member 40 additionally includes an upwardly directed web member 50 having a plurality of regularly spaced slots 56 sized to receive a corresponding upwardly directed web member 58 of an interconnected second channel member 42.

The second channel member 42 also includes a generally horizontal flange 44 having a plurality of removed portions 60 spaced therealong for interacting with the first channel member 40. The length of each removed portion 60 is approximately equal to the width of the first channel member 40. The second channel member 42 also includes a configured upwardly directed web member 58, here illustrated as a tapering web. Tapering surfaces of the upwardly directed web 58 correspond and cooperate with the tapered or recessed portions 24 of the block modules 10 to promote a relatively rigid securement between the channels 40, 42 and the block modules 10.

Figure 9:
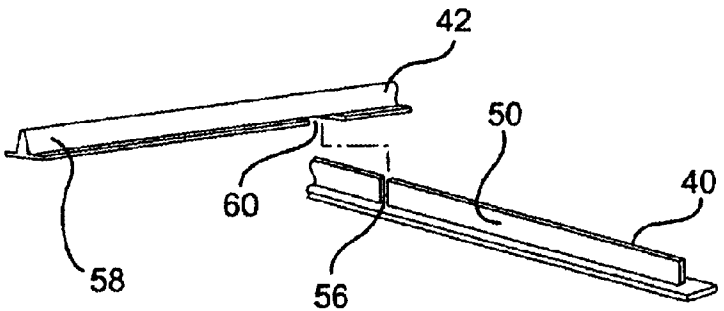
FIG. 9 is a perspective view of the first and second support channel members illustrating the cooperative relationship therebetween.
Figure 10:
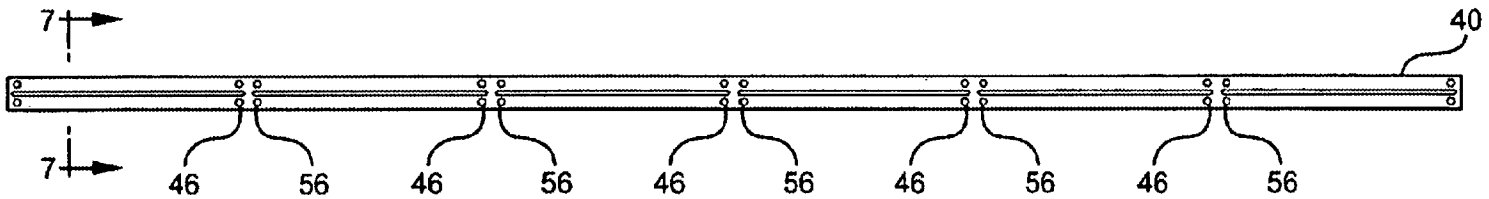
FIG. 10 is atop plan view of the support channel of FIG. 7.
Figure 11:
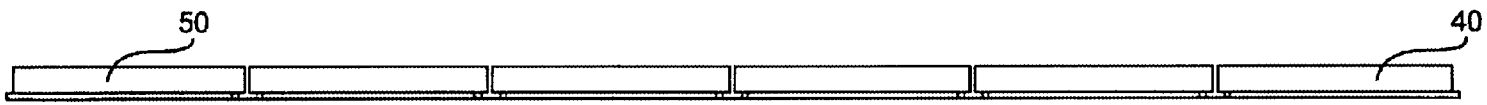
FIG. 11 is a side elevational view of the support channel of FIG. 7.
Figure 12:
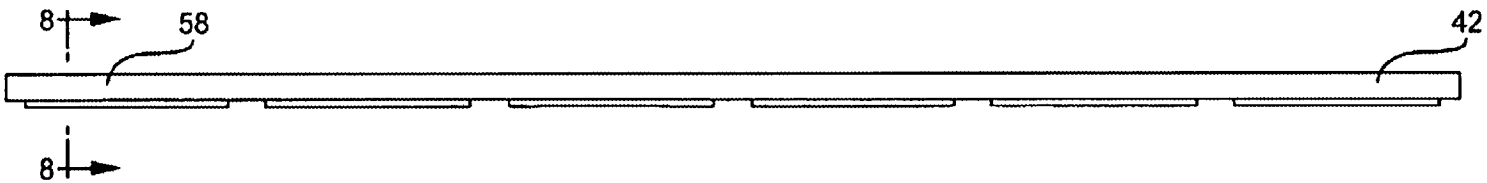
FIG. 12 is a top plan view of the support channel of FIG. 8.
Figure 13:
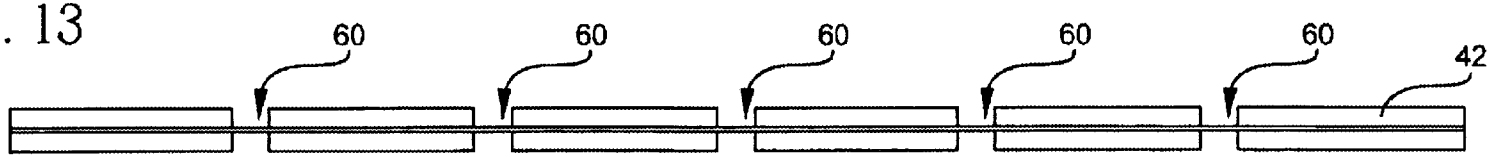
FIG. 13 is a side elevational view of the support channel of FIG. 8.

As illustrated in FIGS. 2 and 9, the first and second channel members 40, 42 are approximately orthogonally coupled together at the slots 56 and removed portions 60 of corresponding members 40, 42. In one preferred method of constructing the grid support structure 12 for the deck modules 10, the plurality of first channel members 40 are secured to the joist 16 of the deck structure 8 by nailing or screwing the channels 40 through apertures 56. The plurality of first channels 40 may be leveled with shims as necessary. Next, the plurality of second channel members 42 are regularly positioned upon the first channel members 40 in grid relationship so that the slot 56 of the first channel member 40 cooperates with the removed portion 60 of the second channel member 42. In this manner, a grid supporting structure 12 is secured to the existing deck structure to receive the deck surface modules 10 as described above.

In comparison, the installation and application of the deck modules 10 of FIGS. 5 and 6, relies on a plurality of underlying support brackets 70 secured to both the joist 16 and the support structure 32 of the modules 10. Additionally, the adjacent modules 10 engage each other through the tongue and groove structures 36, 38 of associated adjacent sides of the modules 10.

Figure 14:
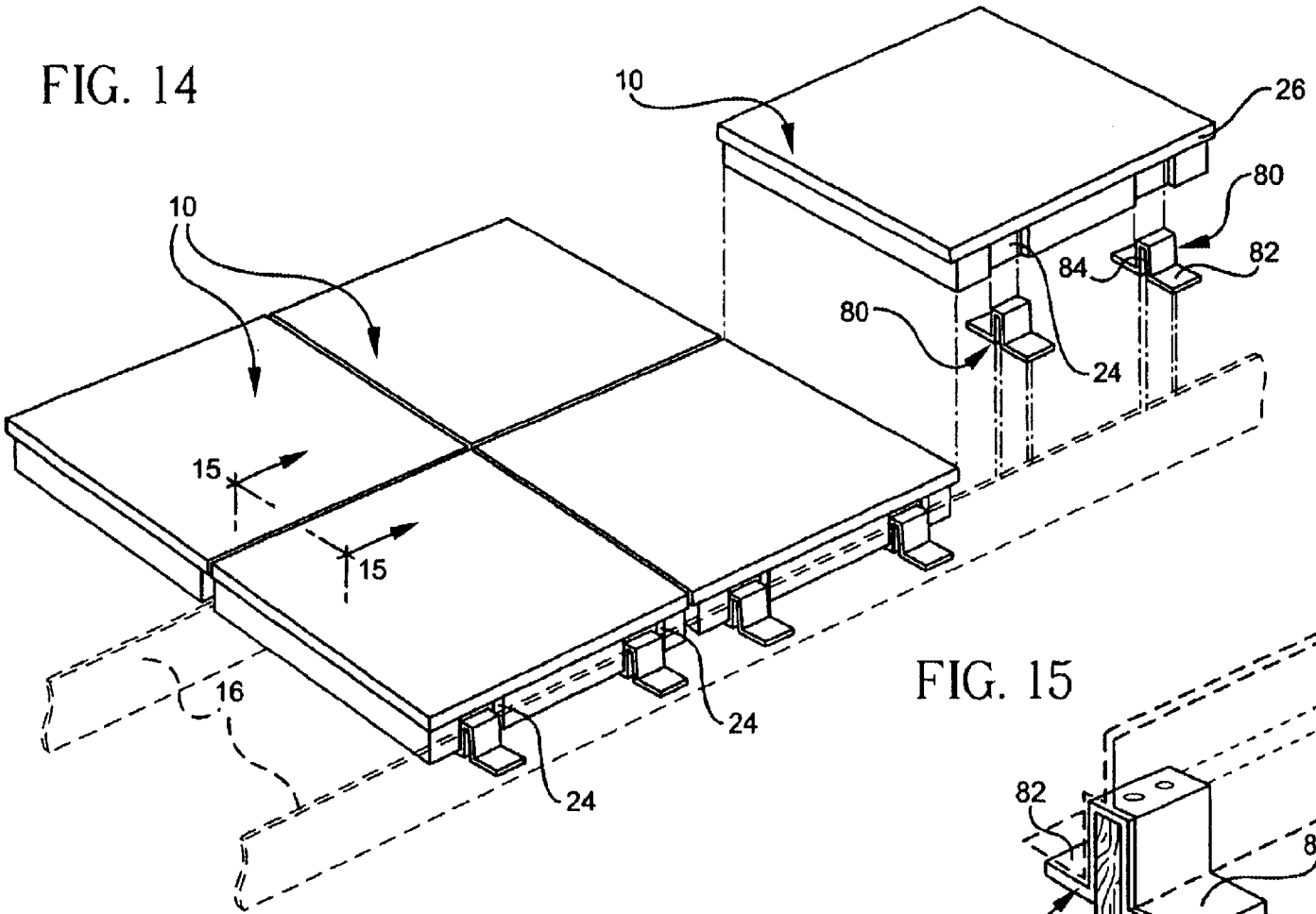
FIG. 14 is a perspective view of another embodiment of the present invention.
Figure 15:
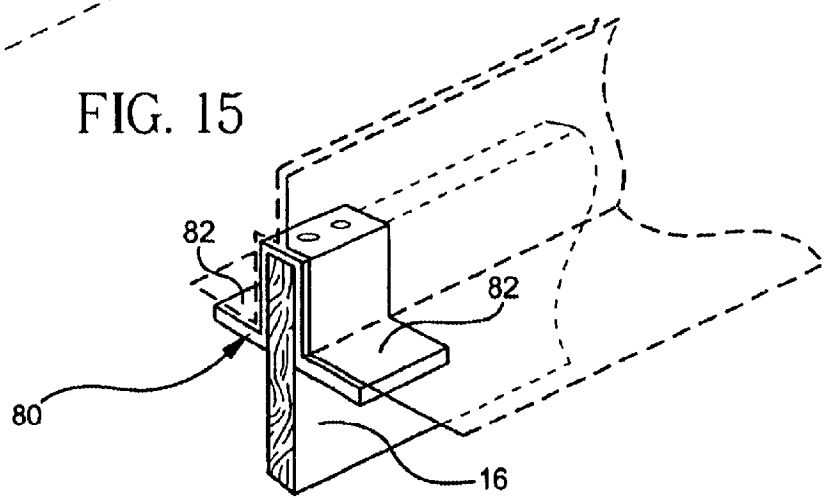
FIG. 15 is a detailed view of FIG. 14 taken along lines 15—15.

FIGS. 14 and 15 illustrates another embodiment of a support structure 12 for the deck block modules 10. In this embodiment, the support structure 12 includes a plurality of connector-spacer devices 80 for connecting adjacent panels 10. The use of a connector-spacer 80 couples adjacent block modules 10 with predictable spacing. The connector 80 may be shaped to define a pair of parallel support surfaces 82 to support the adjacent deck modules 10 at a lower surface. The connector 80 may further be shaped to define a channel 84 sized to be received upon a joist member 16 as illustrated in FIG. 15. The size and construction of the connector-spacers 80 will depend upon the physical and engineering characteristics of the deck system and would otherwise be readily determined by those skilled in the art.

Still referring to FIGS. 14 and 15, an alternative embodiment of the recessed portion 24 feature of the deck modules 10 is illustrated. The recessed portion 24 is vertically defined along a portion of the side edges of the block modules 10 beneath a cantilevered extension portion 26 of the module 10. It should be appreciated by those skilled in the art that the recessed portion 24 of the deck modules may assume a variety of shapes and configurations to effect the goal of minimizing the gap between adjacent installed deck modules 10.

Figure 16:
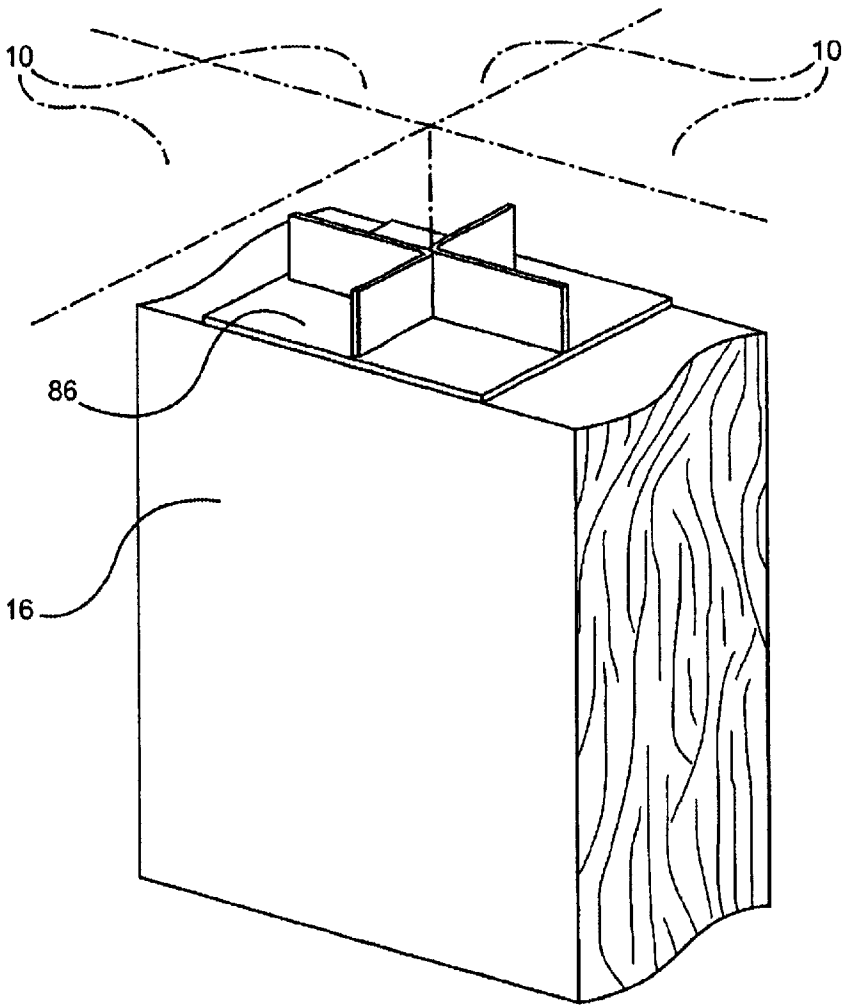
FIG. 16 is a detailed view of yet another embodiment of a support structures for individual block modules.

FIG. 16 illustrates another embodiment of a support structure 12 for the deck block modules 10. In this embodiment, the support structures 12 include a plurality of cross-shaped connector-spacer devices 86 for connecting adjacent panels 10. The connector-spacers 86 would be secured at regular intervals along the joist members 16 of the deck 8, with individual portions of the connector-spacer 86 supporting corresponding deck modules 10.

It is understood that even though numerous characteristics and advantages of the present invention have been disclosed in the foregoing description, the disclosure is illustrative only and changes may be made in detail. Other modifications and alterations are within the knowledge of those skilled in the art and are to be included within the scope of the appended claims.

I claim:

1. A modular deck panel apparatus for a deck structure including a plurality of underlying joist elements, each one of said plurality of joist elements having a top longitudinal surface, said modular deck panel apparatus comprising:

a plurality of modular panels, each of the plurality of modular panels having a first subtstantially planar element being relatively inflexible, each of said plurality of modular elements having a thickness dimension;

a second substantially planar element disposed beneath the first planar element and secured thereto, said second planar element being relatively flexible in relation to the first planar element; and a plurality of elongated members, a first portion of the plurality of elongated members being secured with fasteners passing through apertures in the elongated members and into a series of underlying joist elements, each of said first portion of the plurality of elongated members extending along a top surface of an associated joist across multiple modular panels, and a second portion of the plurality of elongated members spanning between at least three joist elements and engaging the first portion of the plurality of elongated members to restrain the plurality of modular panels, said first portion of the plurality of elongated members extending upwardly away from the top longitudinal surfaces of the joist elements to a predetermined height, said height being substantially less than the thickness dimension of the modular panels, and a gap distance between adjacent pairs of modular panels being substantially less than the thickness dimension of the modular panels.

2. A modular deck panel apparatus according to claim 1, wherein the fist planar element is either a natural stone product or a cement-based product.

3. A modular deck panel apparatus according to claim 1, wherein the second planar element is a fiberglass composite structure.

4. A modular deck panel apparatus for a deck structure including a plurality of horizontal joist elements, said modular deck panel apparatus comprising:

a plurality of modular panels, each having a first substantially planar element being relatively inflexible and of a material selected from among the group including: stone, mineral, tile, and concrete product, each of said plurality of modular elements having a thickness dimension;

a second substantially planar element of a material different than the first planar element, said second planar element being disposed beneath the first planar element and coupled thereto, said second planar element having a predetermined total area, said second planar element supporting the deck panel upon the deck structure at a panel support area, said panel support area being substantially smaller than the predetermined total area; and a plurality of elongated members, a first portion of the plurality of elongated members being secured with fasteners along top longitudinal surfaces of a series of horizontal joist elements, said fasteners passing through apertures in the elongated members, said first portion of the plurality of elongated members extending along the top longitudinal surfaces across multiple modular panels, and a second portion of the plurality of elongated members spanning between at least three joist elements and engaging the first portion of the plurality of elongated members to restrain the plurality of modular panels, said first portion of the plurality of elongated members extending upwardly away from the top longitudinal surfaces of the joist elements to a predetermined height, said height being substantially less than the thickness dimension of the modular panels, and a gap distance between adjacent pairs of modular panels being substantially less than the thickness dimension of the modular panels.

5. A modular deck panel apparatus of claim 4 wherein the first planar element is adhesively secured to the second planar element.

6. A modular deck panel apparatus of claim 4 wherein the second planar element is of a composite material.

7. A modular deck panel apparatus of claim 4 wherein the panel support area is proximate to a periphery of the deck panel.

8. A modular deck panel apparatus of claim 4 wherein the panel support area is proximate to a pair of opposed edges of the deck panel.

9. A modular deck panel apparatus of claim 4 wherein the first planar element and second planar element are equivalent in size.

10. A modular deck panel apparatus of claim 4 wherein the first planar element and second planar element are generally square in shape.

11. A modular deck panel apparatus of claim 4 wherein panel support areas cooperate with portions of the horizontal joist elements of the deck structure.

12. A deck structure comprising:

a deck frame including a series of joists arranged at a generally uniform spacing; and a plurality of modular panels secured to said deck frame by a plurality of elongated members, a first portion of said plurality of elongated members having a series of apertures defined thereupon, each of the first portion of said plurality of elongated members being secured to an associated one of the series of joists with a plurality of fasteners passing through the series of apertures, said first portion of the plurality of elongated members extending across multiple modular panels, and a second portion of said plurality of elongated members extending across at least three joists and engaging the first portion to support the plurality of modular panels against lateral movement, each panel being of a composite layered construction including a top side and a bottom side, each panel including a first layer element defining the top side and of a material providing substantial compressive strength and limited tensile strength, each panel further including a second layer element defining the bottom side and coupled to the first layer element, said second layer element of a material providing substantial tensile strength, and said first portion of the plurality of elongated members extending upwardly away from the top longitudinal surfaces of the joist elements to a predetermined height, said height being substantially less than a thickness dimension of the modular panels, and a gap distance between adjacent pairs of modular panels being substantially less than the thickness dimension of the modular panels.

* * * * *